United States Patent [19]

Baump et al.

[11] 3,975,861

[45] Aug. 24, 1976

[54] AUTOMATED PARKING GATE AND CONTROLS

[75] Inventors: Paul A. Baump; Mario Marinaccio, both of Los Angeles, Calif.

[73] Assignee: Greer Hydraulics, Inc., Los Angeles, Calif.

[22] Filed: May 6, 1974

[21] Appl. No.: 467,070

[52] U.S. Cl. ..... 49/28

[51] Int. Cl.[2] ..... E05F 15/10

[58] Field of Search ..... 49/28, 35, 30, 49

[56] References Cited

UNITED STATES PATENTS

| | | | |
|---|---|---|---|
| 775,768 | 11/1904 | Cowles | 49/28 |
| 1,934,429 | 11/1933 | Jenkins | 49/28 |
| 2,842,876 | 7/1958 | Chicoine et al. | 49/35 |
| 3,678,622 | 7/1972 | Miller | 49/28 |

*Primary Examiner*—Kenneth Downey

*Attorney, Agent, or Firm*—Gardner and Anten

[57] ABSTRACT

A parking gate of the type having a blocking arm located horizontally above the ground during its blocking position and pivotable at one end so as to be raised to permit passage of a vehicle when a switch is activated is disclosed. Electronic logic circuitry is associated with an electrically reversible motor for controlling the timing and direction of the rotation of the motor to control the movement and direction of the blocking arm.

17 Claims, 12 Drawing Figures

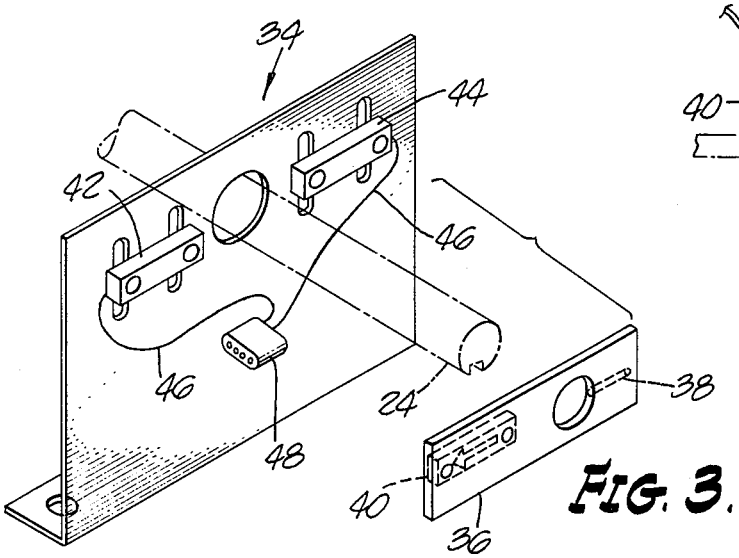
FIG. 3.
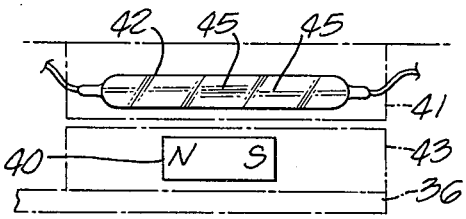
FIG. 4.
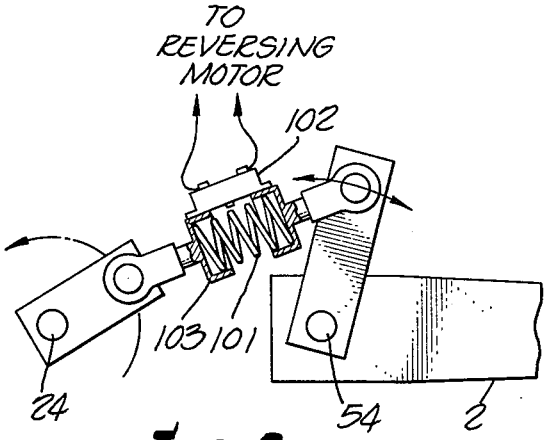
FIG. 8.
FIG. 9.
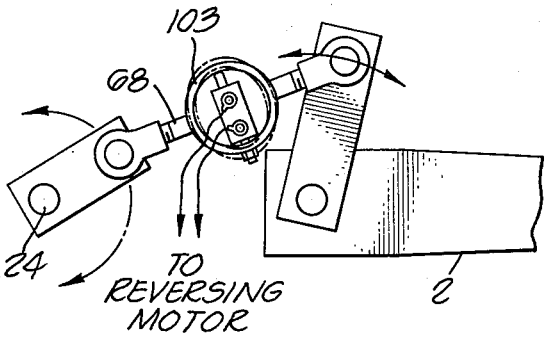
FIG. 10.
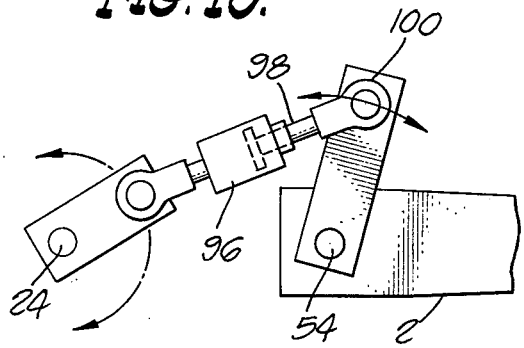
FIG. 11.
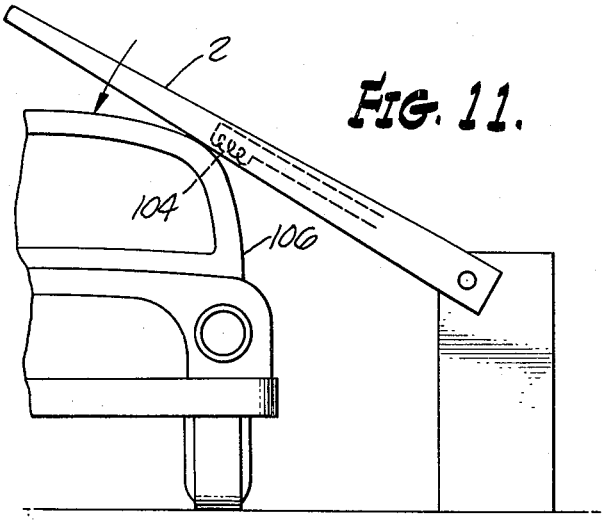

FIG. 5.
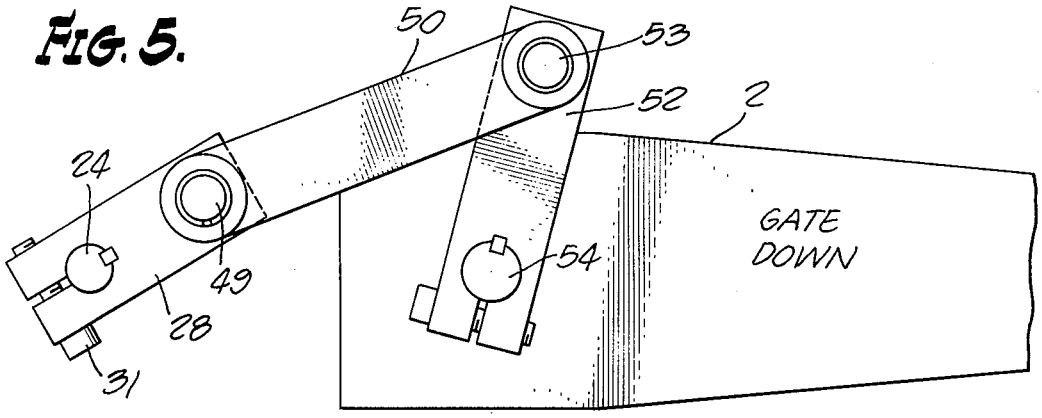
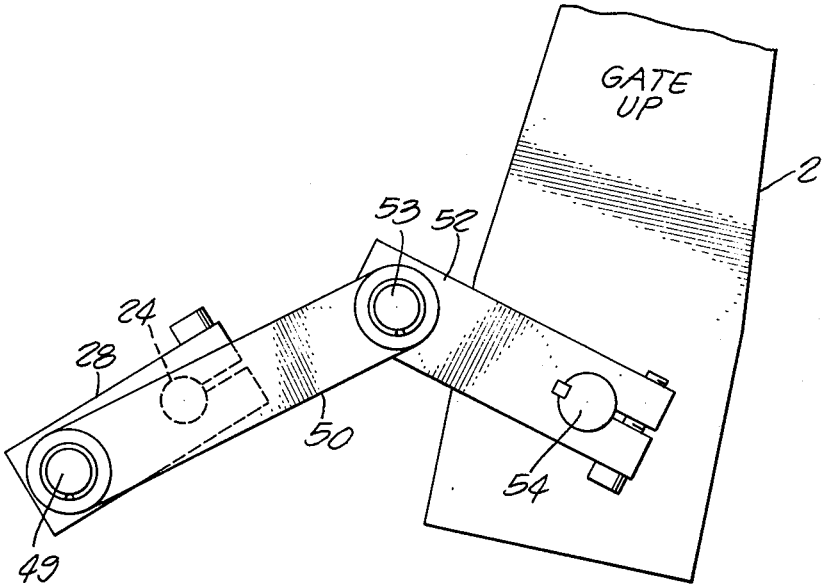
FIG. 6.
FIG. 7.
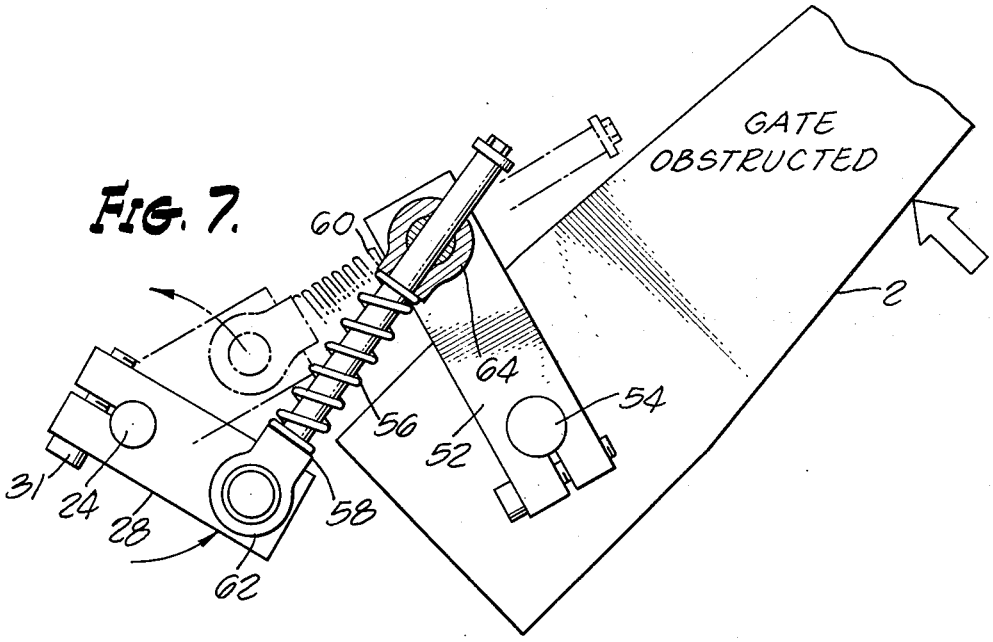

AUTOMATED PARKING GATE AND CONTROLS

BACKGROUND OF INVENTION

The present invention relates to parking gates, and specifically, to parking gates of the type which are fully automated, not requiring the attendance of an operator. These gates are primarily used in security areas and are activated initially by either turning a key, by inserting a coded card, pulling out a ticket or depositing money in a slot.

Being intended primarily for use in unattended areas, one of the primary considerations in the design and operation of any such automated parking gate must be reliability and the capability of the parking gate to adapt to a number of reoccurring conditions presented during the normal course of operation of the gate. If constant mechanical servicing is required not only is the economic justification for the gate reduced but in many instances, especially where the gate is being used in an isolated location, vehicles may be unnecessarily detained in the parking facility. This would understandably result in severe agitation to the user, as well as defeating one of the major purposes of the gate.

A further requirement of an automated parking gate is that it be able to adapt to a reoccurring condition of vehicles moving past the blocking arm while the blocking arm is in the descending mode operation or where more than one car tries to pass the gate while it is still in a semi-blocking position. It is essential that should the blocking arm come into contact with a vehicle as it is descending, no damage should result to the vehicle.

Also, when self-service gates are employed in heavy trafficked facilities, such as parking garages used by commuters who generally will be arriving and departing from the facility during regularly fixed short intervals of time, it is essential that the minimum amount of time be required for each of the cars to pass through the gate. Otherwise, the build up of the incremental delays is translated into vehicles being backed up in the garage awaiting exit. Each such vehicle awaiting exit represents about 10 feet of lateral space. Therefore, an unnecessary delay of only 10 seconds per minute of operation of the gate, assuming two or three cars could have passed through the gate during the 10 seconds, could result in a line of cars 125 feet long in a matter of 5 minutes. This would result in unnecessary congestion at ramps and passageways within the parking garage, increasing the possibility of accidents and other mishaps during the exiting process, further slowing the exiting process. Although less critical due to dispersions of arrival times, a back-up of cars attempting to enter the parking facility might conceivably place vehicles in lanes of traffic outside of the parking facility, subjecting such cars to increased possibility of their being involved in an accident.

The previously available automated parking gates have been inefficient in their usage of time and required completion of an entire cycle of the gate to permit a vehicle to pass. No provision was made for starting or changing the cycle of operation of the parking gate in increased traffic conditions.

Also necessary in an automated parking gate are operational controls for assuring that should a card be inserted or money deposited that the gate will open. Failure to open when money is deposited is an especially severe requirement since it is under such a condition that vandalism is more likely to be promoted.

Most gear reducers previously used for the operation of an automated parking gate operated by either first rotating in one direction 180° to lift the blocking arm and then were electronically reversed to rotate in the opposite direction in order to lower the gate or traveled in one direction only to both lift and lower the blocking arm. However, those systems which were constantly being electronically reversed were mechanically deficient in that only one-half of the gear was used during the lifetime of the gate mechanism, resulting in earlier breakdown and fatigue than necessary.

The previously available parking gate employing a single direction gear reducer which rotated 360° also was deficient. During the first 180° of revolution the blocking arm would be lifted, during the second 180° of revolution, the blocking arm would be lowered. No provision was made in this system for electrically reversing the motor either in response to an obstruction or to increased traffic flow.

Further, in the previously available parking gates cam type swiches have been employed for controlling the operation of the blocking arm of the gate. However, where the parking gate is positioned out of doors and subject to inclement weather, mechanical cam switches are more likely to experience non-contact, resulting in inoperativeness of the switch.

Each of the previously available devices did not have sufficient modes of operation to effectively respond to a number of repeatedly occurring conditions, such as two vehicles trying to pass through the gate at the same time, increased traffic patterns or obstructions in the way of the blocking arm.

It is an object of the present invention to provide an improved automated parking gate for moving a blocking arm which employs a motor gearing arrangement which has a longer mechanical life than those previously available.

An additional object of the present invention is to provide an improved automated parking gate whereby the amount of time wasted in the utilization of the parking gate is minimized.

Another object of the present invention is to provide an improved automated parking gate whereby the amount of time required for a series of vehicles to pass through the device automatically adjusts to the flow of traffic attempting to use the parking gate.

An additional object of the present invention is to provide an improved automated parking gate having a control circuit for operating the automated parking gate so that many modes of operation encountered by the parking gate may be achieved.

Still a further object of the present invention is to provide means for preventing any damage from occurring to a vehicle or other obstruction should the blocking arm descent upon such an obstruction.

Another object of the present invention is to provide electrical circuitry for controlling the operation of the blocking arm.

Other objects an advantages will be evident upon viewing the accompanying drawings and study of the detailed description of the invention.

SUMMARY OF THE INVENTION

In the present invention, a horizontal blocking arm is pivotably mounted at one of its ends by a gear assembly to a motor capable of being electrically reversed, depending on the input signal to the motor from a logic circuit.

The logic circuitry employs elements such as NAND, NOR, INVERTER and flip-flop circuits to provide an output signal to the motor such that during the movement of the blocking arm, the output shaft of a gear reduction box will rotate 360° in one direction. During the first 180° of revolution of the output shaft, the blocking arm, initially in its horizontal blocking position, will be lifted to a substantially vertical position to its non-blocking position. During the second 180° of revolution of the output shaft in the same direction, the blocking arm will again be returned to its horizontal blocking position. In an alternative embodiment of the parking gate, the blocking arm may swing about one end in a horizontal plane, between a first blocking position and a second non-blocking position.

The logic circuitry has the capability of reversing the direction or stopping the drive motor upon the existence of certain predetermined conditions. One such condition is that the starting switch is closed while the blocking arm is in the process of being moved from its non-blocking position to its blocking position. A second such condition causing the drive motor to operate in a reverse condition is if the blocking arm hits an obstruction during its downward path. A third condition in which the motor may be operated in a reverse direction or stopped is if a vehicle or other object activates a switch located past the gate, as the blocking arm is moving to its blocking position.

Thus, the blocking arm is controlled by an electrically reversible motor which normally causes a output shaft to rotate in one direction through a 360° revolution but on appropriate predetermined conditions the motor may be operated in a reverse direction to rotate the output drive shaft in a reverse direction up to a total of 180°.

Two reed switches are activated by a permanent magnet rotating responsive to the output shaft of the gear reduction box in such a manner so as to indicate the raised and lowered position of the blocking arm. The reed switches activate a circuit to shut off the drive motor when either of such limits are reached. While in the preferred embodiment the electrical reed switches are used so as to prevent or minimize failure, any other type of switch such as pressure switches, optical switches or the like may be used.

The logic circuitry may be selectively capable of providing a predetermined signal which will stop or lower the blocking arm a fixed distance before coming to a stop. For example, rather than reversing in response to a second car activating a switch past the blocking arm in an attempt to rush past the blocking arm before it can move to its non-blocking position, the blocking arm may continue to descend for a fixed time or stop. The lowering stopping of the blocking arm in such a circumstance will cause uncertainty in the driver of the second vehicle trying to rush through the gate and he is likely to bring the vehicle to a stop rather than risk damage.

Appropriate safety circuits are employed to prevent the simultaneous activation of two contrary modes of operation of the parking gate, such as attempting simultaneously to operate the drive motor in both a clockwise and counterclockwise direction.

The invention may be more readily understood by reference being made to the accompanying description of the preferred embodiments and proposed variations. In the drawings:

FIG. 3 is an expanded perspective view of the upper and lower limit switches;

FIG. 4 is a representation of an expanded view of a reed switch in proximation to a permanent magnet.

FIG. 5 is a side view of the blocking arm support linkage with the blocking arm in its blocking position;

FIG. 6 is a side view of the blocking arm support linkage with the blocking arm in its non-blocking position;

FIG. 7 is a side view of the support linkage including a spring biasing element with the blocking arm incurring an obstruction.

FIG. 8 is a side view of the support linkage including a spring biased switching element associated with the linkage for reversing the direction of the drive motor.

FIG. 9 is a top view of the spring biased switching element shown in FIG. 8.

FIG. 10 is an alternative support linkage assembly in which pneumatic pressure is used.

FIG. 11 is a side view of the blocking arm having a proximity coil associated with said blocking arm being obstructed by a vehicle.

Figure 1:
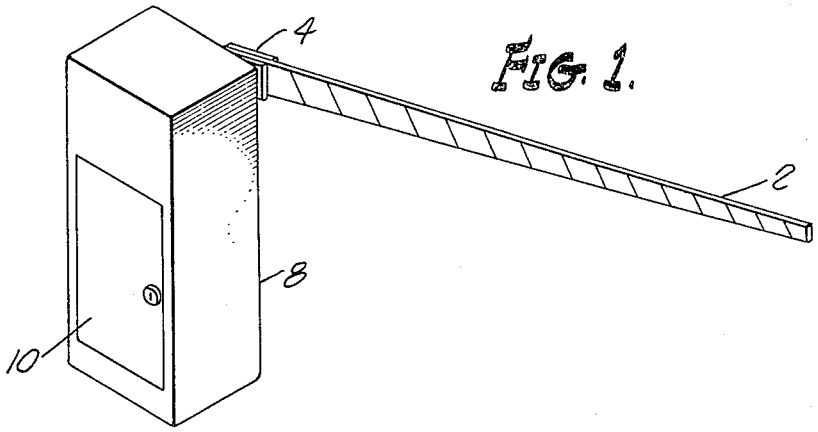
FIG. 1 is a perspective view of the automated parking gate.
Figure 12:
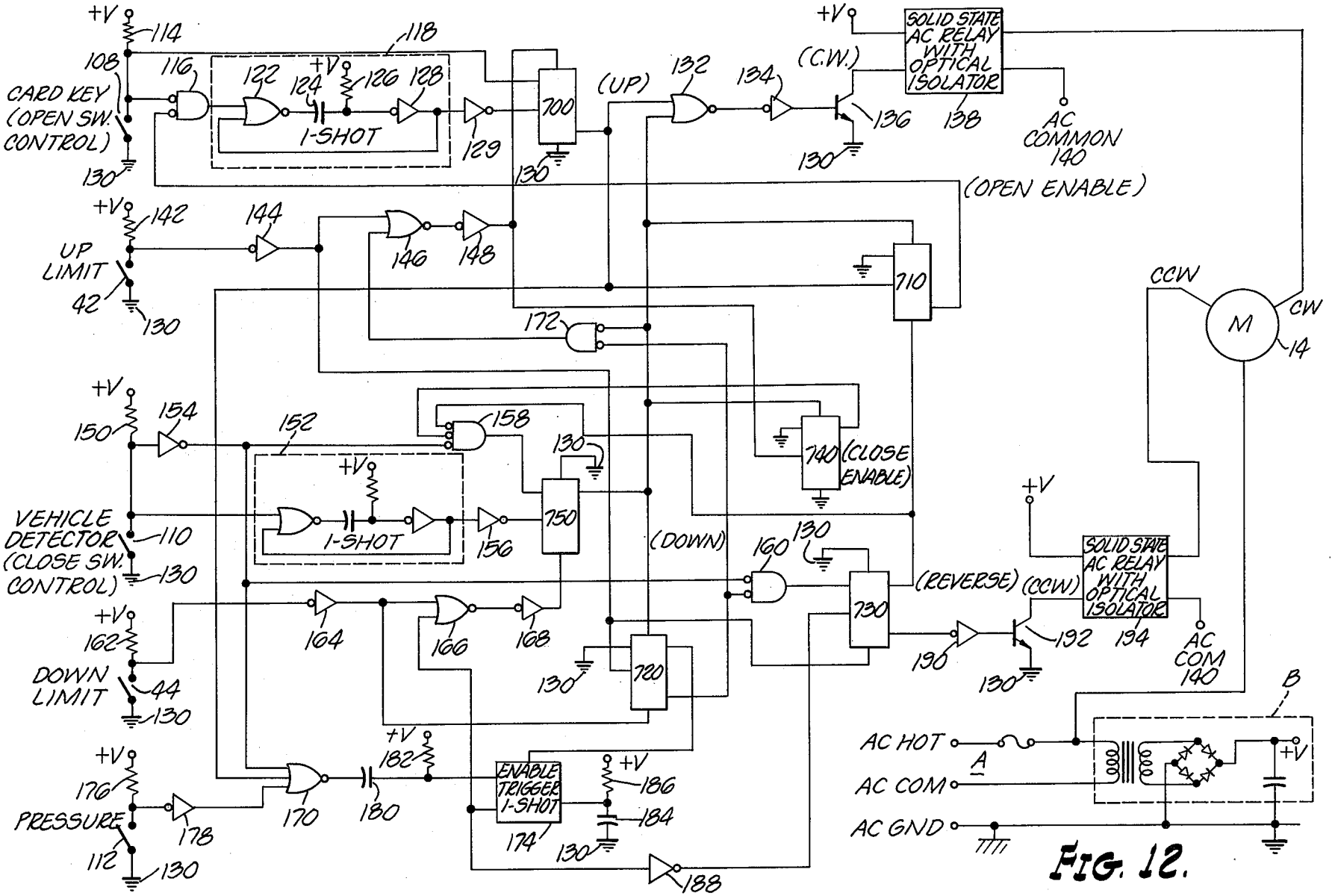

FIG. 12 is a view of the logic circuitry in the preferred embodiment of the parking gate. Referring in detail to the Figures of the drawings, in FIG. 1 a perspective view of the gate assembly is shown. The gate assembly has a blocking arm 2 pivotably mounted at one end 4 to a gear reduction assembly 6, shown in greater detail in FIG. 2, concealed within a housing 8 with an entrance door 10 which may be locked.

Figure 2:
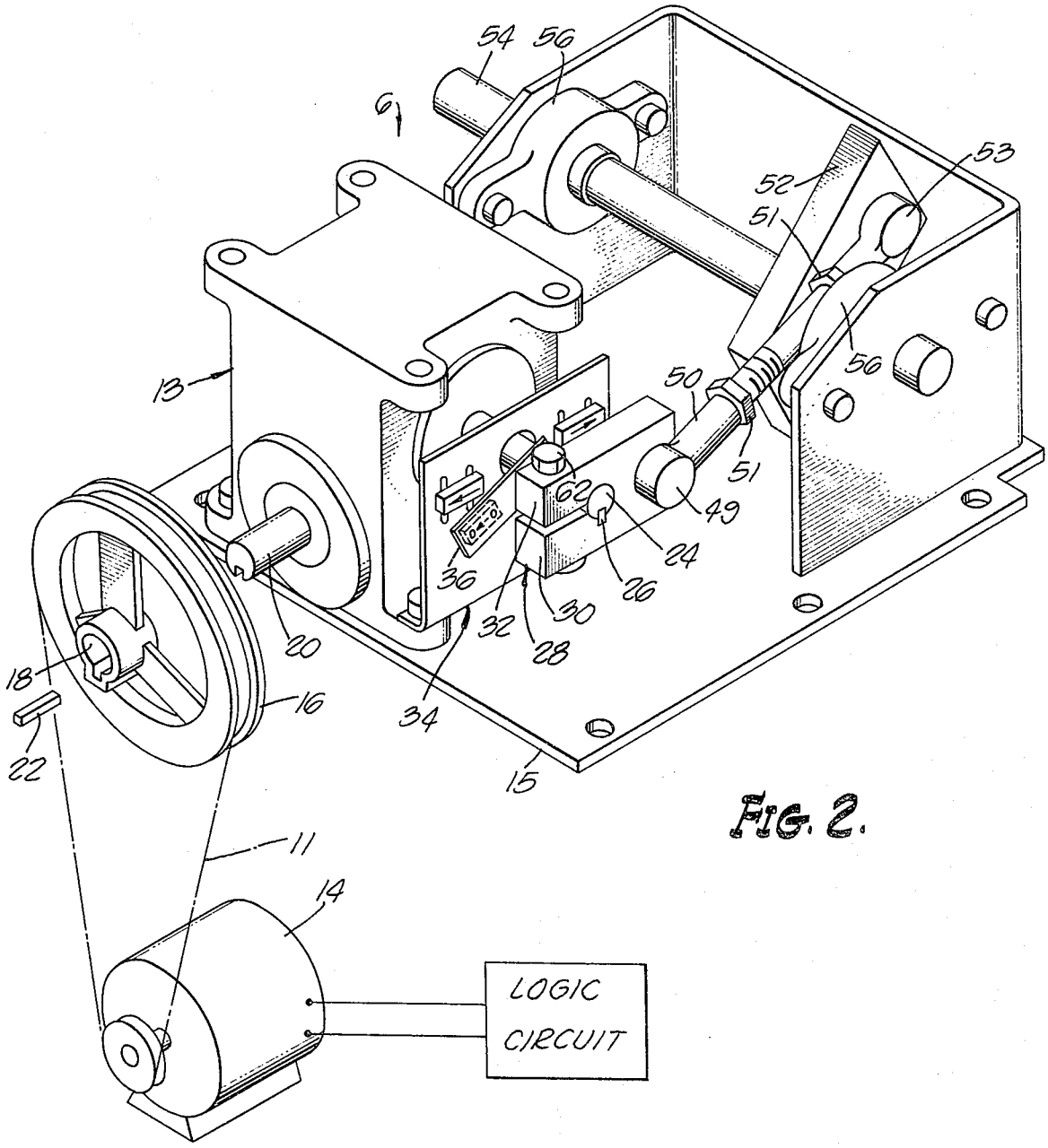
FIG. 2 is a perspective view of the gear reduction box and linkage assembly.

The gear assembly 6 for operating the lifting and lowering of the blocking arm 2 is shown in greater detail in FIG. 2. An electrically reversible motor 14 is connected by belt 11 and belt driven wheel 16 to input shaft 20 of gear reduction box 13. Shaft key 22 fixes the center 18 of belt driven wheel 16 to input shaft 20 of the gear reduction box 13. The output shaft 24 of gear reduction box 13 is secured by key 26 to rotating actuator arm 28, consisting of a rectangular member having two clamping arms 30 and 32 with a bolt 31 extending through the arms to grip the shaft and maintain key 26.

Attached to the supporting plate 15 is a switch support assembly 34, shown in greater detail in FIG. 3. The switch support assembly 34 does not rotate with the gear reduction box output shaft 24, but is maintained in fixed relationship to the support plate 15.

Fixed to the output shaft 24, between the switch support assembly 34 and the rotating actuator arm 28 is a magnet support member 36 which is attached to output shaft 24 by key 38 so that the magnet support member 36 rotates in response to the rotation of output shaft 24. A permanent magnet 40 is fixed to the outward end of the magnet support member 36.

The switch support assembly 34 includes two reed switches 42 and 44 fixed on opposite sides of the gear reduction output shaft 24. The switches are connected by electrical conductors 45 to a connector 48, which is electrically connected to the logic circuitry, FIG. 12. The switches 42 and 44 are reed type switches, which are activated by coming into proximity of the magnetic field of permanent magnet 40.

Pivotably connected to one end of the rotating actuator arm 28 is one end 49 of a translation rod 50, the length of which is adjustable by nuts 51. The other end 53 of translation rod 50 is pivotably mounted to a rocking actuator arm 52, which is fixed to blocking arm support shaft 54. The blocking arm support shaft 54 is fixed to the blocking arm 2, so as to control its operation. Rotating actuator arm 28, rocker actuator arm 52 and translation rod 50 form a rocker assembly.

Referring to FIGS. 5 and 6, it may be seen that when the output shaft 24 is turned counter-clockwise as viewed in FIG. 5, that the end 49 of the translation rod 50 of the rocker assembly will be pulled along with the rotating actuator arm 24 in a counter-clockwise direction. At the same time, the end 53 of translation rod 50 pivotably attached to the end of rocker acturator arm 52 will be pulled in a counter-clockwise direction, thus, turning blocking arm supporting shaft 54 in a counter-clockwise direction. Blocking arm 2 being rigidly connected to the supporting shaft 54 will likewise turn in a counter-clockwise direction so as to move to a new blocking position, as shown in FIG. 6.

Due to the respective length of translation rod 50 and the circumferential path of rotating actuator arm 28, by the time that end of translation rod 50, pivotably connected to rotating actuator arm 28, has traveled 180 ° from the position shown in FIG. 5, rocker actuator arm 52 has traveled its maximum distance in a counter-clockwise direction and still is above the center line of the blocking arm support shaft 54 as shown in FIG. 6. As translation rod 50 continues to travel in a counter-clockwise direction responsive to the rotation of rotating acutator arm 28, the end 53 of translation rod 50 which is pivotably mounted to rocker actuator arm 52 begins to travel in a clockwise direction, and rotates rocker actuator arm 52 and the blocking arm support shaft 54 in a clockwise direction, rotating the blocking arm in a clockwise direction until the blocking arm 2 arrives at a blocking position as originally shown in FIG. 5.

Thus, the turning of blocking arm support shaft 54 in either a clockwise or counter-clockwise direction controls the positioning of blocking arm 2 so as to position the blocking arm 2 in either a vertical or horizontal orientation.

The operation of the switches 42 and 44 on switch support assembly 34 and the magnet 40 supported in magnet support member 36 will be discussed in greater detail below.

In FIG. 4, a close-up view of reed switch 42 is shown with permanent magnet 40 supported on magnet support member 36 in proximation to reed switch 42. The reed switch 42 and permanent magnet 40 are enclosed in housings 41 and 43. The contacts 45 of reed switch 42 are attracted to one another when in the magnetic field of permanent magnet 40, thus completing an electrical circuit.

The closing of reed switch 42 will indicate that the blocking arm 2 has reached its maximum upward position and will serve to turn off motor 14. The closing of reed switch 44 serves to indicate that blocking arm 2 has reached its lowest horizontal position and similarly serves to turn off motor 14. Detailed description of the circuitry employed for turning off motor 14 in response to the closing of reed switches 42 and 44 will be discussed in greater detail during reference to FIG. 12.

In FIG. 7, a modification of the rocker assembly is shown embodying a tension spring 56 mounted along translation rod 50. The ends of the tension spring 56 abutt shoulders 58 and 60 on bearings 62 and 64. The shoulder affixed to bearings 64 associated with rotating actuator arm 52 has an opening, not shown, through which the translation rod 50 passes. During operation, should the blocking arm 2 hit an obstruction, shown as an arrow in FIG. 7, the tension spring 84 will compress, as shown in dotted lines, and prevent the gate from lowering further during the portion of the rotational cycle of blocking arm support shaft 54, thus preventing damage to the obstruction.

FIGS. 8, 9, 10 and 11 all represent means for controlling the movement of the blocking arm, each such modification including apparatus associated with the extension member for switching the direction of the reversible motor 14 should the blocking arm be obstructed during its downward path.

In FIG. 8, a tensioning spring 101 if fitted in a housing 103 between the ends of translation rod 50. Associated with the tensioned spring 101 is a switch 102 activated by a predetermined compression of spring 101. Should blocking arm 2 hit an obstruction, spring 101 will be compressed activating switch 102 and reversing the direction of reversible motor 14. FIG. 9 is a top view of the apparatus of FIG. 8.

In FIG. 10, a pneumatic tensioning device is employed between the ends of translation rod 50. A cylinder 96, closed at one end, has a piston 98 fixed to bearing 100, fitted within cylinder 96. Upon hitting an obstruction, the increase in pressure within cylinder 96 will activate the reverse mode of electrically reversible motor 14.

In FIG. 11, a proximity coil detection system 104 is incorporated in blocking arm 2. When the proximity coil detection system 104 approaches an obstruction, such as a vehicle 106, a signal is given to the logic circuit which switches the direction of the reversible motor 14, thus lifting the blocking arm 2 away from the obstruction.

Referring to FIG. 12, showing the logic circuitry employed in the preferred embodiment of the parking gate, one side of starting switch 108 responsive to the insertion of a key or a card is connected through resistor 114 to voltage supply V. The non-grounded side of starting switch 108 is connected to the input of NAND 116 and to the input of flip flop circuit 70. The output of NAND 116 is connected to the input of one shot trigger 118, the one shot trigger 118 consisting of a NOR circuit, a capacitor 124, a resistor 126 and an INVERTER 128. The output of the NOR 122 is connected to the negative terminal of capacitor 124. The positive terminal of capacitor 124 is connected to the voltage supply V through resistor 126 to the input of INVERTER 128. The output of INVERTER 128 is connected through INVERTER 129 to the clock of flip flop 700 and to the input of NOR 122.

The output of flip flop 700 is connected to the input of NOR 132, to the clock input of flip flop 710 and to the input of NOR 170. The output of NOR 132 is connected through INVERTER 134 to the base of transistor 136. The emitter of transistor 136 is connected to ground 130 and the collector of transistor 136 is connected to the input of solid state AC relay with optical isolator 138. The second input of solid state AC relay 138 is connected to voltage supply V. One output is connected to the AC common 140 and the other to the electrically reversible motor 14. In the present circuit the activation of solid state AC relay 138 serves to drive the electricity reversible motor 14 in a clockwise direction. The solid state switch may also include a triac for governing the operation of electrically reversible motor 14.

One side of up limit switch 42 is connected to ground 130 and the other side is connected through resistor 142 to voltage supply V and to the input of INVERTER 144. The output of INVERTER 144 is connected to the input of NOR 146, the clock of flip flop 720 and to the reset of flip flop 730. The output of NOR 146 is connected to the input of INVERTER 148, the output of INVERTER 148 being connected to the preset of flip flop 700 and to the clock of flip flip 740. The output of flip flop 740 is connected to the input of NAND 158.

Vehicle detector switch 110 has one side connected to ground at 130 and its other side through resistor 150 to voltage supply V, to the input of one shot trigger 152, identical to the one shot trigger 118 described above, and to the input of INVERTER 154. The output of one shot trigger 152 is connected through INVERTER 156 to the clock of flip flop 750. The output of INVERTER 154 is connected to the input of NAND 158, the input of NOR 170 and to the input of NAND 160. The output of NAND 158 is connected to the data input of flip flop 750, which has it preset grounded at 130.

Down limit switch 44 has one side grounded at 130 and its other side connected through resistor 162 to voltage supply V and to the input of INVERTER 164. The output of INVERTER 164 is connected to NOR 166 and to the reset of flip flop 720. The data input of 720 is connected to ground 130. The output of NOR 166 is connected through INVERTER 168 to the reset of flip flop 750. The output of flip flop 750 is connected to the presets of flip flops 710, 720, and 740 and to the input of NOR 132 and NAND 172. The output of flip flop 710 is connected to the input of NAND 116.

One output of flip flop 720 is connected to the input of NAND 160 and to the input of NAND 172. The output of NAND 172 is connected to the input of NOR 146. The output of NAND 160 is connected to the data input of flip flop 730. The preset of flip flop 730 is connected to ground 130.

Pressure switch 112 has one side connected to ground at 130 and its other side connected through resistor 176 to voltage supply V and through INVERTER 178 to the input of NOR 170. The output of NOR 170 is connected to the negative terminal of capacitor 180, the positive terminal of capacitor 180 being connected through resistor 182 to voltage supply V and to the input of one shot trigger 174. The trigger delay pulse is derived by the control line which is connected to capacitor 184 which is connected to ground 130 and to resistor 186 which is connected to supply voltage V. The output of one shot trigger 174 is connected to the input of NOR 166 and through INVERTER 188 to the clock of flip flop 730. One output of flip flop 730 is connected to the reset of flip flop 710 and to the input of NAND 158.

The second output of flip flop 730 is connected through INVERTER 190 to the base of transistor 192, the emitter of transistor 192 being connected to ground 130 and the collector of transistor 192 being connected to the input of solid state AC relay with optical isolator 194. The second input is connected to voltage supply V. One output is connected to AC common 140 and the other output to the electrically reversible motor 14 and will force counter-clockwise rotation of the motor 14 when activated.

The logic circuit is powered by an unregulated power supply B while the electrically reversible motor 14 is powered by a 115 voltage AC power line A.

Referring to FIG. 12, the logic circuitry for controlling the operation of the electrically reversible motor 14 in response to various electrical outputs is shown:

In FIG. 12, five switching elements, each operated by a different condition incurred during the use of the automated parking gate are shown:

Starting switch 108 is activated in response to the insertion of a key, card or money and normally initiates the lifting of blocking arm 2.

Up limit switch 42 is activated by the permanent magnet 40 on magnet support member 36 coming in close proximity to the elements 45 contained in reed switch 42.

The vehicle detector switch 110 is activated by a vehicle or other such object coming within range of the detector. The switch will release after the vehicle has passed through the gate and exceeded the range of the detector. The vehicle detector switch 110 may be either a mechanical pressure switch set in the ground on one or both sides of the path through the gate, a proximity coil, a photo-electronic detection means embodied in the housing 8 or other sensing means.

Down limit switch 44 is activated by permanent magnet 40 coming into close proximity to the elements 45 contained in reed switch 44.

Pressure switch 112 is activated by pressure being applied to blocking arm 2 as it is in its descending mode, such as the result of the blocking arm 2 hitting an obstruction, such as a vehicle, Pressure switch 112 is only activated upon a predetermined amount of pressure being presented to the blocking arm. The pressure switch 112 may be incorporated in the blocking arm 2 as shown in FIG. 11, within the housing 8 associated with translation rod 50, a pneumatic pressure detector, a spring tension element, an object sensing element, an electronic circuit responsive to the increased current drawn by the motor 14 as a result of an increased load condition which would be caused by the existence of an undesired object in the path of the blocking arm, or other sensing means.

The logic circuitry associated with each of the switches and their interrelationship will now be discussed in detail.

In operation, the logic circuit shown in FIG. 12 for controlling the operation of the automatic parking gate operates as follows:

Upon insertion of key, a card, the pulling of a ticket or the insertion of money, starting switch 108 is closed. The closing of starting switch 108 serves as one input of NAND 116. However, in order to initiate an OPEN condition, the output of open enable flip flop 710 must be low when the open switch 108 is closed as a result of the insertion of the key or card. The output of open enabling flip flop 710, set by flip flop 750, is low whenever the blocking arm 2 is either moving in a down direction or has reached a down position and a reverse cycle has not been initiated.

A low to high transition at the output of NAND 116 will initiate the one shot trigger 118, providing a high pulse at the output of inverter 128 determined by RC network 124, 126. The high-to-low transition will strobe the OPEN request (switch 108 closed) into flip flop 700 establishing the gate OPEN condition. The one shot trigger 118 prevents switch bounce or noise from initiating an erroneous OPEN condition.

A high signal at the output of flip flop 700, open command, will saturate transistor 136 and activate the solid state switch 138, driving the motor 14 in the clockwise direction.

As the output shaft of the gear reduction box rotates so as to bring the permanent magnet 40 in proximity with up limit switch 42, up limit switch 42 will close, providing a high input to NOR 146, resetting flip flop 700 and turning off reversible motor 14. The output of NOR 146 also serves to set close-enabling flip flop 740, to permit a subsequent downward movement of blocking arm 2.

As the vehicle passes the blocking arm 2 the detector loop buried in the ground will activate the detector switch 110. A high pulse will be generated at the output of one shot trigger 152 as the vehicle detector switch releases (as a result of the vehicle passing beyond the range of the detector). The output of flip flop 750 will be set high if the output of NAND gate 158 is high during the low to high transition at inverter 156.

To establish a down condition, flip flop 740 output must be low and the flip flop 730 output connected to the NAND 158 input must be low. If the down conditions are present the high output of flip flop 750 will again actuate transistor 136 and activate the solid state switch 138, driving motor 14 in a clockwise direction.

As the output shaft of gear reduction box rotates so as to bring the permanent magnet 40 into proximity with the elements of down limit switch 44, closing the down limit switch 44, flip flop 750 is reset, thus turning off power to reversing motor 14.

The electrically reversible motor 14 may be operated in its reverse direction in a limited number of situations and is controlled by the output of flip flop 730. Flip flop 730 is in a reverse enabling condition only when flip flop 720 is set, indicating the existence of a downward movement of the blocking arm 2.

The reverse mode of operation of electrically reversible motor 14 may occur in the following three situations, each where an input to NOR 170 is present.

1. If as the blocking arm 2 descends it hits an obstruction, pressure switch 112, associated either with the arm or by a photo-sensitive device or other sensing means, will be closed serving as an input to NOR 170, triggering one shot trigger 174, which will set the "reverse" flip flop 730 on the trailing edge of the one shot pulse, initiating the reverse or counter-clockwise operation of reversible motor 14, thus lifting the blocking arm 2.
2. If the blocking arm 2 is in its downward travel, an "open" signal occurs as a result of the insertion of a key, a card, etc., as an input to NOR 170 again causing the electrically reversible motor 14 to be activated, thus lifting the blocking arm 2. This saves time in not requiring the blocking arm 2 to perform a complete down cycle. The output of flip flop 710 is set to prevent another open signal from setting the up flip flop 700 until a new close cycle is initiated.
3. The third instance of initiating the reverse condition is for the vehicle detector switch 110 closure to be activated while the blocking arm is in its downward travel as a result of a second car trying to pass through the gate without inserting a key, a card, or money, before the gate can come down.

Operation under this condition can be altered to satisfy particular customer requirements such as to ignore the second vehicle detector switch 110 closure and force the blocking arm 2 down on the second vehicle, or stop the blocking arm as a result of the switch closure.

Flip flop 710 and flip flip 740 are made necessary due to the use of the 360° revolution of the motor to move the blocking arm 2 from its blocking to its non-blocking position and then back to its blocking position. The flip flop 710 and 740 serve as status or memory indicators for indicating to the circuitry the present condition of operation of the blocking arm and motor.

An open command will only cause the blocking arm to raise if the output of flip flop 710 is low. This enable condition occurs as soon as a down cycle is initiated and will be terminated by either a reverse condition or when the gate has reached the UP position as a result of the UP limit switch closure.

In the same manner, the close command will only cause the blocking arm to lower if the output of flip flop 740 is low. This enable condition occurs as soon as the blocking arm reaches the UP limit and is terminated as soon as the blocking arm starts to lower.

What is claim is:

1. An automatic access control assembly comprising:

a. an access control member movable between an access-denying position and an access-permitting position;

b. an electric motor having an output member which is adapted to be rotated in a forward direction and in a reverse direction;

c. coupling means between said output member and said access control member for moving said access control member between its said access-denying position and its said access-permitting position in response to operation of said motor;

d. control means connected to said motor for controlling operation of said motor; said control means comprising electric circuit means including;

1. means for operating said motor in response to a first predetermined signal to rotate said output member in its said forward direction to move said access control member from its access-denying position toward its access permitting position;
2. means for operating said motor in response to a second predetermined signal to rotate said output member in its said forward direction to move said access control member from its access-permitting position toward its access-denying position; and
3. means for operating said motor in response to a predetermined signal to rotate said output member in its said reverse direction to move said access control member toward its access-permitting position.

2. The automatic access control assembly of claim 1 wherein said electric motor is adapted to rotate said output member approximately 180° in said forward direction to move said access control member from an access-denying position to an access-permitting position, and to rotate said output member an additional approximately 180° in said forward direction to move said access control member to an access-permitting position.

3. The automatic access control assembly of claim 1 in which said electric motor is switchable in response to a predetermined signal so as to selectively stop said output member from rotating in its said forward direction and to rotate said output member in its said reverse direction.

4. The automatic access control assembly of claim 1 wherein said control means includes electric circuit means; said electric circuit means including limit switching means electrically connected to said electric motor for stopping rotation of said output member when said access control member reaches its said access-denying position and for stopping rotation of said output member when said access control member reaches its said access-permitting position.

5. The automatic access control assembly of claim 4 wherein said limit switching means includes a first limit switching means for stopping rotation of said output member when said access control member reaches its said access-permitting position and a second limit switching means for stopping rotation of said output member when said access control member reaches its said access-denying position.

6. The automatic access control assembly of claim 4 wherein said limit switching means comprises at least one magnetic switch.

7. The automatic access control assembly of claim 1 wherein said control means includes a starting switch electrically connected to said electric motor for causing rotation of said output member in said forward direction to move said access control member from its said access-denying position toward said access-permitting position.

8. The automatic access control assembly of claim 7 wherein said control means further includes means operable in response to activation of said starting switch while said access control member is moving from its access-permitting position toward its said access-denying position to switch said electric motor so as to operate said electric motor in a reverse direction, thereby causing rotation of said output member in its said reverse direction to move said access control member toward its said access-permitting position.

9. The automatic access control assembly of claim 1 wherein said control means comprises obstruction sensing means; said obstruction sensing means being electrically connected to said electric motor for signaling said electric motor and causing said electric motor to rotate said output member in its said reverse direction when said access control member is moving from an access-permitting position toward an access-denying position in response to said obstruction sensing means sensing an obstruction.

10. The automatic access control assembly of claim 9 in which said obstruction sensing means includes a pressure-sensitive switching means; said pressure-sensitive switching means being adapted to be activated in response to said access control member contacting an obstruction.

11. The automatic access control assembly of claim 1 wherein said control means includes signal means responsive to the passage of an object past said access control member while said access control member is moving toward its said access-denying position for signaling said electric motor to cause rotation of said output member in said reverse direction to move said access control member toward its said access-permitting position.

12. An automatic access control assembly for controlling access to a given area, comprising:

a. a blocking arm movable between a blocking position and a nonblocking position;

b. a reversible electric motor having an output shaft operatively connected thereto; said reversible motor being adapted to selectively rotate said output shaft in either a clockwise direction or a counterclockwise direction;

c. interconnecting means between said output shaft and said blocking arm for moving said blocking arm between its said blocking position and its said nonblocking position in response to operation of said motor;

d. control means connected to said reversible electric motor for controlling operation of said motor; said control means comprising electric circuit means including:

1. means for operating said motor in response to a first predetermined electrical signal to rotate said output shaft in one of its said clockwise or counterclockwise directions to move said blocking arm from its blocking position toward its nonblocking position;

2. means for operating said motor in response to a second predetermined electrical signal to rotate said output shaft in said one of its said clockwise or counterclockwise directions to move said blocking arm from a nonblocking position toward its said blocking position; and 3. means for operating said motor in response to a predetermined electrical signal to rotate said output shaft in the other of its said clockwise or counterclockwise directions to move said blocking arm toward its said nonblocking position.

13. The automatic access control assembly of claim 12 wherein said control means includes a first switch operatively associated with said reversible electric motor for signaling said motor to operate so as to rotate said output shaft in its said one of its said clockwise or counterclockwise directions to move said blocking arm from a blocking position toward a nonblocking position 14. The automatic access control assembly of claim 12 wherein said control means includes sensing means and switch means operatively associated with said reversible electric motor to signal said electric motor to operate so as to rotate said output shaft in said other of its clockwise or counterclockwise directions to move said blocking arm toward its said nonblocking position in response to said sensing means sensing an object in the path of said blocking arm.

15. The automatic access control assembly of claim 14 wherein said sensing means comprises a pressure-sensitive switch.

16. The automatic access control assembly of claim 12 wherein said control means includes switch means operable in response to actuation thereof while said blocking arm is moving from a nonblocking position toward a blocking position for causing reversal of said electric motor to rotate said output shaft in said other of its said clockwise or counter-clockwise directions to move said blocking arm toward its said nonblocking position.

17. An automatic gate assembly for controlling access to a parking area, comprising:

a. a parking gate movable between a closed position and an open position;

b. a reversible electric motor having a drive shaft operatively connected thereto; said reversible motor being selectively operable to rotate said drive shaft in one direction or an opposite direction;

c. interconnecting means disposed between said drive shaft and said parking gate and mechanically interconnecting said drive shaft and said parking gate for moving said parking gate between its said closed position and its said open position in response to operation of said electric motor and drive shaft; and d. a logic circuit electrically connected to said motor for initiating operation of said motor to cause said drive shaft to rotate and move said parking gate between its said open and closed positions; said logic circuit means including:

1. a starting switch for operating said motor to rotate said drive shaft approximately 180° in its said one direction to move said parking gate from its closed position toward its open position;
2. a second switch adapted to be actuated by the moving of a vehicle past said gate for causing operation of said electric motor so as to rotate said drive shaft an additional approximately 180° to move said parking gate to its said closed position;
3. a third switching means operatively associated with said electric motor for interrupting rotation of said drive shaft in its said one direction during said additional 180° cycle to interrupt movement of said parking gate toward its said blocking position and to cause said electric motor to reverse and rotate said drive shaft in its said opposite direction to move said parking gate toward its said open position; and
4. obstruction sensing means operatively associated with said electric motor for sensing an obstruction while said parking gate is moving toward its said blocking position; said obstruction sensing means being operable in response to its sensing an obstruction while said parking gate is moving towards its closed position to signal said electric motor to operate in a reverse mode so as to rotate the drive shaft in its said other direction to move said parking gate toward its said open position.

* * * * *